US005290507A

United States Patent [19]

Runkle

[11] Patent Number: 5,290,507

[45] Date of Patent: Mar. 1, 1994

[54] METHOD FOR MAKING TOOL STEEL WITH HIGH THERMAL FATIGUE RESISTANCE

[76] Inventor: Joseph C. Runkle, 30 Ancient County Way Ext., Manchester-By-The-Sea, Mass. 01944

[21] Appl. No.: 657,642

[22] Filed: Feb. 19, 1991

[51] Int. Cl.[5] ..... B22F 3/14

[52] U.S. Cl. ..... 419/14; 419/18; 419/23; 419/49

[58] Field of Search ..... 75/236, 239, 240, 246; 419/6, 14, 18, 23, 39, 49

[56] References Cited

U.S. PATENT DOCUMENTS

| | | | |
|---|---|---|---|
| 3,556,780 | 1/1966 | Holtz, Jr. | 419/15 |
| 3,561,934 | 2/1971 | Steven | 29/182.7 |
| 3,653,982 | 4/1972 | Prill | 148/31 |
| 3,746,518 | 7/1973 | Holtz, Jr. | 29/182.7 |
| 3,809,540 | 5/1974 | Mal et al. | 75/237 |
| 3,842,471 | 10/1922 | Polhall et al. | 29/125 |
| 3,977,837 | 8/1976 | Mal et al. | 29/182.7 |
| 4,112,564 | 9/1978 | Loqvist | 29/148 |
| 4,146,388 | 3/1979 | Lafferty et al. | 75/0.5 AE |
| 4,469,514 | 9/1984 | Holtz, Jr. | 75/236 |
| 4,546,527 | 10/1985 | Fukuda et al. | 29/132 |
| 4,569,823 | 2/1986 | Westin | 419/23 |
| 4,576,642 | 3/1986 | Holtz, Jr. | 75/239 |
| 4,618,540 | 10/1986 | von Holst et al. | 428/552 |
| 4,747,225 | 5/1988 | Gstettner et al. | 42/76.02 |
| 4,756,677 | 7/1988 | Hribernik et al. | 419/8 |
| 4,764,488 | 8/1988 | Saito et al. | 501/95 |
| 4,913,737 | 4/1990 | Nakamura et al. | 75/228 |
| 4,936,912 | 6/1990 | Revankar | 75/240 |
| 4,954,058 | 9/1990 | Revankar | 419/18 |
| 4,958,422 | 9/1990 | Oshima et al. | 29/129 |
| 4,968,347 | 11/1990 | Ramesh et al. | 75/244 |
| 4,973,356 | 11/1990 | von Holst et al. | 75/233 |
| 5,054,682 | 10/1991 | Mistry | 228/194 |

FOREIGN PATENT DOCUMENTS

| | | | |
|---|---|---|---|
| 0023733 | 9/1980 | European Pat. Off. . | |
| 0341643 | 9/1989 | European Pat. Off. | C22C 33/02 |
| 89108269 | 11/1989 | European Pat. Off. . | |
| 3308409 | 3/1983 | Fed. Rep. of Germany . | |
| 3310038 | 3/1983 | Fed. Rep. of Germany | B22F 3/14 |
| 3507332 | 3/1985 | Fed. Rep. of Germany . | |
| 3508982 | 5/1985 | Fed. Rep. of Germany | C22C 38/36 |
| 55-41949 | 3/1980 | Japan . | |
| 63-266038 | 11/1988 | Japan | C22C 33/02 |
| 2-088747 | 3/1990 | Japan | C22C 38/18 |

OTHER PUBLICATIONS

Wan, "Machinable and Heat Treatable Steel-Bonded Tungsten Carbide", *Modern Developments in Powder Metallurgy*, vol. 17, 1984, pp. 193-219.

Queeney et al., "Wear Resistance of WC and VC Reinforced Tool Steel As-Sintered Composites", *Modern Developments in Powder Metallurgy*, vol. 20, 1988, pp. 77-85.

Queeney et al., "Elevated Temperature Wear Resistance of Sintered $Al_2O_3$ Reinforced M2 Tool Steel", *Modern Developments in Powder Metallurgy*, vol. 20, pp. 87-94.

*Powder Metallurgy International*, vol. 16, No. 6, 1984, pp. 267-271.

Rackoff et al., *Rolls For The Metalworking Industries*, Chap. 16 "Tungsten Carbide Rolls", pp. 281-306.

Champagne, "Properties of WC-Co/Steel Composites", R & H M Sep. 1987.

Kennametal, *Carbide Components* brochure, Wear Systems Division.

Ferro-Tic: Carbide Performance With Ready Machinability, Div. of Chromalloy.

Tarkan & Mal, "Steel-Bonded Carbide Improves PM Tooling", *Tooling & Production Magazine*, Apr. 1974.

Mal & Tarkan, "Steel Bonded Carbides: Lubricity and Wear Resistance", Sintercast Division, Chromalloy American Corp.

*Primary Examiner*—Donald P. Walsh
*Assistant Examiner*—Ngoclan T. Mai
*Attorney, Agent, or Firm*—James E. Maslow

[57] ABSTRACT

Method of forming and a new class of tool steel macrocomposites having improved thermal fatigue resistance and improved wear resistance, formed of tool steel powder mixed with carbide powder under hot isostatic pressing.

25 Claims, 4 Drawing Sheets

METHOD FOR MAKING TOOL STEEL WITH HIGH THERMAL FATIGUE RESISTANCE

The present invention relates to a group of iron based macrocomposites and to their method of fabrication, particularly for use as thermal fatigue and wear resistant parts, coatings or claddings.

Isostatic pressing generally is used to produce powdered metal parts to near net sizes and shapes of varied complexity. Hot isostatic processing is performed in a gaseous (inert argon or helium) atmosphere contained within a pressure vessel. Typically, the gaseous atmosphere as well as the powder to be pressed are heated by a furnace within the vessel. Common pressure levels extend upward to 45,000 psi, with temperatures exceeding about 1300° C.

In the hot isostatic process, the powder to be hot compacted is placed in a hermetically sealed container, usually made of a weldable metal alloy such as steel or glass. The container deforms plastically at elevated temperatures. Prior to sealing, the container is evacuated, which may include a thermal out-gassing stage to eliminate residual gases in the powder mass that may result in undesirable porosity, high internal stresses, dissolved contaminants and/or oxide formation.

In the hot isostatic process, densification to full density is achievable with most materials. The resulting mechanical properties are equivalent to those of wrought parts in similar structural condition. In some materials, the properties of the hot isostatic product are superior because of reduced anisotropy. Hot isostatic pressing has been used extensively in commercial production of high speed tool steel billets and near net shapes of full density.

On the one hand, heat treated steels have low abrasion resistance and high toughness. Therefore it is desirable to overcome such low abrasion resistance. On the other hand, carbide compositions (carbides), for example tungsten carbide (a ceramic) or the cemented tungsten carbide cobalt (a cermet) have outstanding wear resistance (i.e., to abrasion, corrosion and wear). However, these carbides are usually too brittle to be used as structural elements (which must possess the ability to withstand impact). Furthermore, wear resistant materials (such as carbides) typically are more costly than common alloy steel. As well, cemented carbides, due to their brittleness and lower coefficient of thermal expansion cannot be metallurgically clad or bonded to large steel substrates without great difficulty or expense.

Therefore, it is desirable to form a substrate of less expensive steel essentially in net shape and then to coat or "clad" a wear resistant material over this substrate. In a typical hot isostatic cladding process, a wear resistant alloy powder (e.g., a carbide powder) to be compacted is poured and vibratorily packed into a container of desired shape along with a formed alloy-steel substrate. The powder mass is then simultaneously compacted and bonded to the substrate during the hot isostatic treatment to form a wear resistant coating on the steel substrate. While this process raises initial tool costs, it is generally considered cost effective given the increased life of the formed tool.

Champagne, et al., in "Properties of WC-Co/Steel Composites", International Journal of Refractory and Hard Metals, Vol. 6, No. 3, September 1987, pp. 155–160, compare the relationship of high abrasion resistance (generally referred to hereinafter as wear resistance) and toughness of cemented carbides, white cast irons, austenitic manganese steels, and heat treated steels. This comparison is shown in FIG. 1. Also a class of wear resistant macrocomposite materials is described having moderate wear resistance and moderate toughness. These macrocomposites are a combination of less than 30 percent by volume cemented cermet carbides and a heat treated steel matrix, and thus benefit from the wear advantages of cemented carbides and the toughness of the heat treated steel.

In Champagne et al., cemented carbide particles were produced by agglomerating fine tungsten carbide and cobalt powders and subsequently consolidating by vacuum sintering. The particles were nearly spherical and in the 0.1 to 1 mm size range. Selected amounts of the particles and steel powders were wet mixed, and green compacts were fabricated from these mixtures. After drying, preforms were compacted and hot isostatically treated. It was observed by Champagne et al. that, while the wear losses of composites (including tungsten carbide cobalt particles) in a steel matrix decrease rapidly with the content of the tungsten carbide, no important decrease in wear losses was expected by increasing the volume fraction of tungsten carbide cobalt particles above 30 percent in the steel matrix. Hence the proportion of tungsten carbide cobalt particles in the composites of Champagne et al. was limited to a maximum content of 30 volume percent.

Furthermore, it was also observed in Champagne et al., that tungsten carbide particles were strongly bonded to the steel matrix after hot isostatic treatment at 1100° C. at 15,000 psi for one hour, with the matrix constituted of ferrite and pearlite, as expected for a hypoeutectoid steel containing 0.5 weight percent carbon. Carbon enrichment of the steel matrix from dissolution of the tungsten carbide cobalt particles was very limited even during hot isostatic treatment up to six hours at 1100° C. However, the matrix of the composites so treated at temperatures above 1100° C. changed from a ferrite-pearlite to a fully pearlitic structure, indicating a major carbon enrichment of the matrix at the expense of the tungsten carbide of the tungsten carbide cobalt particles, thus weakening the tungsten carbide and promoting eta phase formation. Furthermore, the interfaces between the tungsten carbide cobalt particles and the steel matrix became quite thick above 1100° C., as a result of diffusion. At 1250° C. the flow of cobalt out of the particles into the matrix was considered detrimental to ductility and strength of the composites since the resulting carbides were said to be brittle and to have lower mechanical properties.

One problem with pure cemented WC/CO cermet is that it cannot be easily bonded to steel substrates due to its relatively low (compared to steel) coefficient of thermal expansion and its intrinsic brittleness. It is therefore an object of the present invention to obtain a new class of materials from which parts and claddings may be economically formed having good wear resistance and toughness, with improved thermal fatigue resistance and having a mean coefficient of thermal expansion and a thermal conductivity midway between those of high speed tool steel and tungsten carbide.

It is another object of the present invention to provide an economical alloy with improved thermal fatigue resistance and resistance to thermal cracking.

It is another object of the present invention to form a tool steel part having good wear resistance and toughness in a combination previously unavailable for general use.

It is yet another object of the present invention to provide an improved wear resistance coating of good toughness which can be applied in a hot isostatic pressing process to enhance the wear resistance of a formed part with improved thermal fatigue resistance and resistance to thermal cracking, and which can be hot isostatic diffusion bonded, or brazed, directly to a tool steel substrate.

It is a further object of the present invention to provide methods of achieving the foregoing objects.

SUMMARY OF THE INVENTION

In practice of the present invention, a new class of hot isostatically treated tool steel macrocomposites is disclosed having, among other features, minimized degradation by thermal fatigue (e.g., heat checking) and longer life. These new macrocomposites are formed with a ceramic or cermet carbide microcomposite held in a matrix of hard, tough tool steel. The tool steel itself is also actually a microcomposite of hardenable steel and carbides. These macrocomposites also have improved wear resistance.

Various tool steels may be employed in practice of the invention. Many tool steels are presently commercially available, such as steels of the AISI-SAG type W, S, O, A, D, H, T, M, L, F, and P, and others. (See Metals Handbook, 1969, Vol. 1, 8th Ed., A.S.M. Publ., p. 638, incorporated herein by reference.) (Also available are the CPM series tool steels such as developed under various patents assigned to Crucible Steel, Inc.)

M-4 and T-15 tool steels are each commonly employed in the formation of hard tool steel tools and bits. M-4 tool steels are characterized by approximating the following composition:

| | |
|---|---|
| Carbon | 1.3 |
| Chromium | 4.0 |
| Vanadium | 4.0 |
| Tungsten | 5.5 |
| Molybdenum | 4.5 |
| (Balance iron, with incidental impurities) | |

T-15 tool steels are characterized by approximating the following composition:

| | Weight Per Centimeter |
|---|---|
| Carbon | 1.5 |
| Chromium | 4.0 |
| Vanadium | 5.0 |
| Tungsten | 12.0 |
| Cobalt | 5.0 |
| (Balance iron, with incidental impurities) | |

These are hard tool steels. Softer tool steel alloys are also available in various compositions. An example is T-1, which is characterized by approximating the following composition:

| | |
|---|---|
| Carbon | 0.70 |
| Chromium | 4.00 |
| Vanadium | 1.00 |
| Tungsten | 18.00 |
| (Balance iron, with incidental impurities) | |

Tool steels and carbides (such as cemented carbides) have distinct and at times contrasting qualities. Tool steels, particularly high speed tool steels, exhibit higher thermal expansion coefficients and better toughness than carbides but lower hardness, lower thermal conductivity and lower abrasion resistance. Also, while the hardness of tool steels can be varied by heat treatment, the hardness of carbides does not respond to heat treatment.

In practice of the present invention, thermal fatigue is minimized by forming a macrocomposite from components having a combination of low thermal expansion and high thermal conductivity. As a result, the hardness and toughness benefits of tool steel are married with the low thermal expansion coefficient, hardness and wear resistance benefits of carbides in a new class of macrocomposites having improved thermal fatigue resistance and lifespan.

In the presently disclosed macrocomposites a tool steel matrix is used which is metallurgically and physically more compatible with a carbide (such as a tungsten ceramic or cermet powder) than is a common alloy steel matrix, and therefore enables higher concentrations of carbide to be employed with beneficial results. The higher amount of carbide provides better wear resistance, and use of a tool steel matrix provides better toughness and lower cost compared to a carbide coating alone. The higher concentration of carbide also decreases the thermal expansion coefficient of the composite relative to tool steel. Thus, the macrocomposite of the present invention achieves a thermal expansion coefficient which is a product of the beneficial mixture of the microcomposite components.

In one aspect of the invention, generally, a macrocomposite material having improved thermal fatigue resistance includes (a) a matrix of diffusion-bonded powdered tool steel from the group consisting of M, T, H, D, W, S, O, A, L, F, P or CPM series tool steel, and (b) islands of diffusion-bonded carbide powder affixed within said matrix. The islands may include a ceramic or a cermet.

The carbides used in practice of the present invention preferably are formed from various refractory metals, such as tungsten, titanium, molybdenum, niobium, vanadium, silicon, hafnium, and tantalum. These carbides may be formed as a brittle but wear resistant carbide (a ceramic), or may include a metallic cementing agent, such as cobalt, cobalt-chromium, nickel, iron, and other metallic agents, to form a less brittle cemented carbide (a cermet). Preferred carbides include tungsten carbide and titanium carbide. Another useful carbide is nickel cemented titanium carbide. More particularly, in one example, the tool steel includes M-4 or T-15 steel and the carbide is tungsten carbide or tungsten carbide at about 6 to 17 percent cobalt; in an alternative example the tool steel includes H-11 steel and the carbide is tungsten carbide at about 12 percent cobalt. Generally the carbide is selected from the group consisting of: W, TaC, TiC, NbC, NiC, VC, and SiC, including cobalt, nickel, chromium or molybdenum binder phases, for example, or the carbide may be formed from the group consisting of: tungsten carbide or tungsten carbide with tantalum carbide at less than about 1.5 percent cobalt binder, or tungsten carbide or tungsten carbide with tantalum carbide at about 3-30 percent cobalt, cobalt/-chromium, or nickel binder, or titanium carbide at 3-30 percent with nickel or nickel molybdenum binder. The cermet generally has the following compositional range: carbide 97 to 75 percent, binder 3 to 25 percent.

The volumetric ratio of tool steel microcomposite powder to carbide microcomposite powder is desirably between 3:1 and 1:3 and preferably is about 1:1. The carbide microcomposite powder may include angularly or spherically shaped particles ranging up to about 500 μm, but possibly with carbide microcomposite powder of spherically shaped particles less than 1000 μm and preferably less than 100 μM. Preferably the tool steel has a carbon content of between about 1 and 2 percent.

In another aspect of the invention, a process for forming a macrocomposition having improved thermal fatigue resistance includes the steps of mixing a tool steel microcomposite alloy powder and a carbide microcomposite powder to form a powder mass in a manner that said powders are generally well distributed in the mass, hot isostatically treating a hermetically sealed portion of the mass to a temperature of at least 1100° C. at at least 2-3000 psi until the mass is diffusion bonded into a macrocomposite having a tool steel matrix, formed from the tool steel microcomposite powder, and carbide islands, formed from the carbide microcomposite powder dispersed in the matrix. This process may include placing a substrate in a treatment container and then cladding the mass onto the substrate. The temperature is preferably held around 1200°-1250° C. for a time period and pressure sufficient to achieve full density. In a preferred process the treatment is raised to about 1250° C. for about 4 hours at about 15,000 psi.

The mixing of powders may include plasma spraying, or may include mechanically mixing the powders in a magnetic field, such as with tumble or vibratory mixing in a magnetic field.

As a result of the invention, the brittleness of the carbides (ceramic or cermet) is less of a factor in performance because the macrocomposite provides a tough crack-resistant matrix to bind the brittle carbides. Thus cracks that start in the carbide are blunted or arrested by the tool steel matrix. Also, while the tool steel is not tougher than alloy steel, it is more compatible with the carbides. Hence, in practice of the present invention it is possible to improve the already high wear resistance of tool steel by adding large amounts of carbide which can be combined with the tool steel and fully densified and bonded at high temperature via hot isostatic pressing. Furthermore, given the better match in coefficients of thermal expansion between the macrocomposite and steel substrate, the invention is very useful for diffusion bonding of a wear resistant coating of adequate toughness onto a substrate.

BRIEF DESCRIPTION OF THE DRAWINGS

These and other features and advantages of the present invention will be more fully understood by reference to the following detailed description in conjunction with the attached drawings in which like reference numerals refer to like elements and in which.

DETAILED DESCRIPTION OF THE PREFERRED EMBODIMENTS

Figure 1:
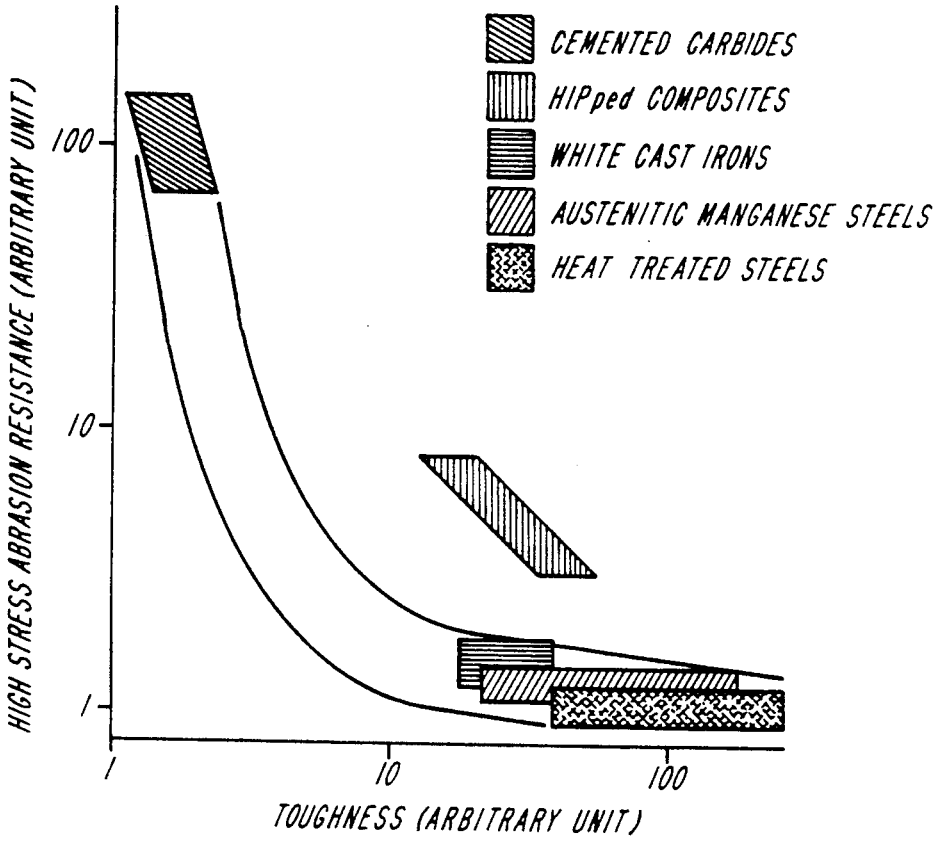
FIG. 1 (PRIOR ART)
FIG. 1 is a prior art graph comparing high stress abrasion resistance versus toughness for several classes of materials.
Figure 2:
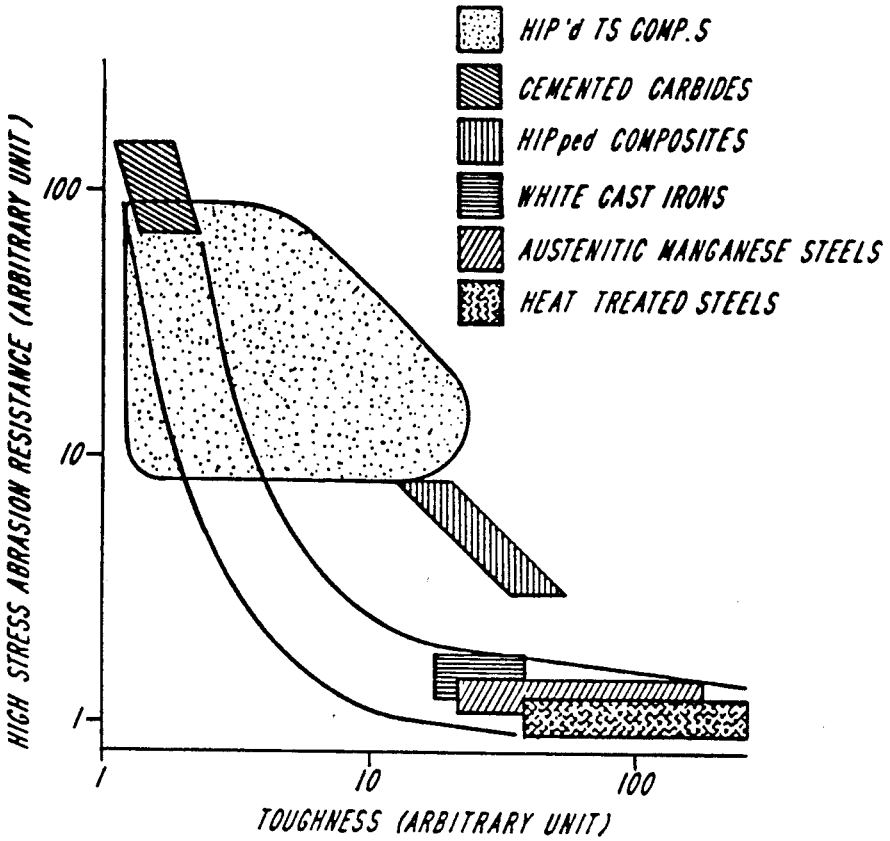
FIG. 2 is a graph comparing high stress abrasion resistance versus toughness for the several materials of FIG. 1 and the new class of macrocomposite materials of the present invention.

Turning now to FIG. 2, it will be understood that a new class (10) of macrocomposite materials enjoys good wear resistance and good toughness, with improved thermal fatigue resistance relative to tool steel.

Figure 3:
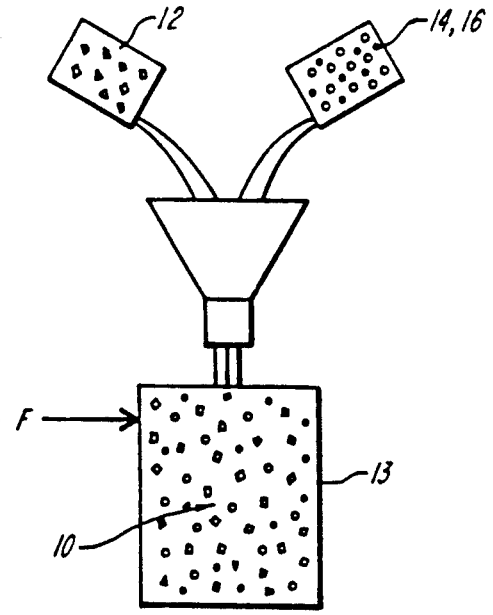
FIG. 3 shows the mixing of two microcomposite powders.

As more particularly shown in FIG. 3, the present invention is a macrocomposite formed from combining a microcomposite tool steel powder 12 with a microcomposite carbide ceramic powder 14 or a cermet powder 16. The prealloyed, gas-atomized tool steel powder and the carbide powder each maintain their integrity as they are mixed. Preferably the powders are combined in a mixing chamber 13. This combining is preferably done mechanically or vibratorily within a magnetic field F, such that the powders remain mixed as they are then poured into a hot isostatic treatment container (not shown).

Figure 4:
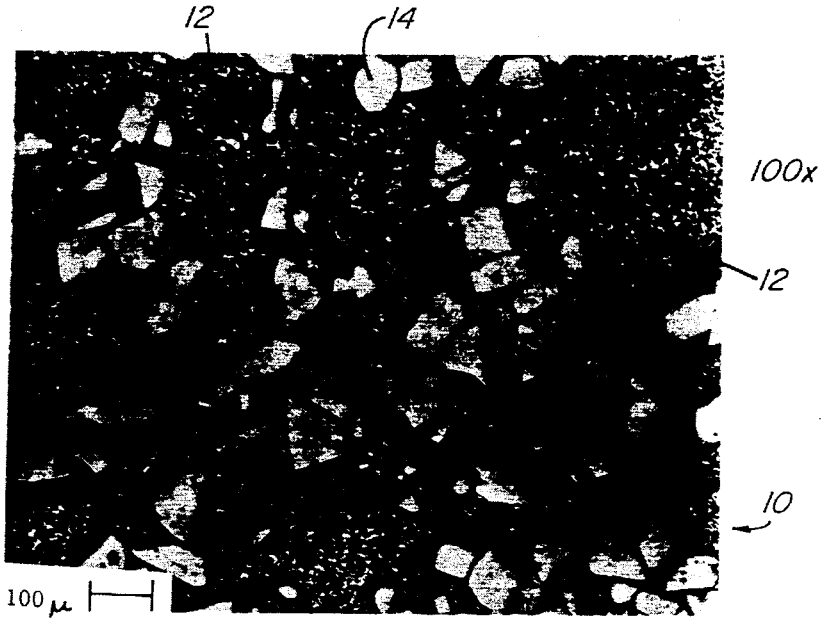
FIG. 4 is a reproduction of a photograph at 100X magnification of an embodiment of the present invention incorporating a pure tungsten carbide ceramic combined with T-15 high speed tool steel matrix, at 1:1, HIP treated at about 1200° C. for two hours, 15 Kpsi, heat treated at about 1200° C. for 30 minutes, air quenched, double tempered at about 565° C. for three hours.
Figure 5:
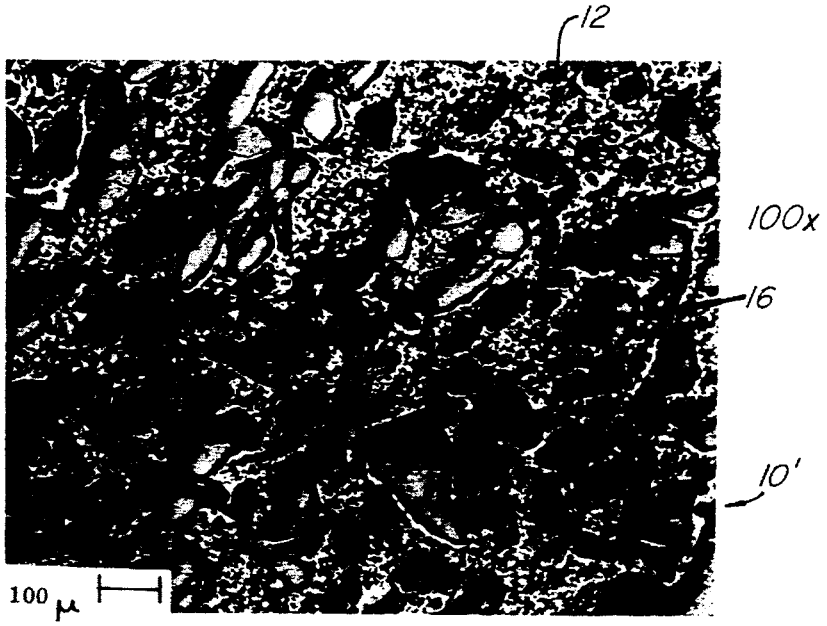
FIG. 5 is a reproduction of a photograph at 100 magnification of a macrocomposite of the present invention incorporating a tungsten carbide cobalt cermet microcomposite in an M-4 high speed tool steel matrix, at 1:1, Hi 1) treated at about 1205° C. for two hours at 15 Kpsi.

As shown in FIGS. 4 and 5, after the hot isostatic treatment, a portion of the resulting macrostructure 10, 10' has the tool steel microstructure 12 and the remainder has either the ceramic 14 or cermet 16 microstructure of FIG. 4 or 5. The resulting macrocomposite 10, 10' therefore, exhibits the characteristics of the microcomposites and therefore benefits both from the toughness of the tool steel and the wear resistance of the carbide compound and the low thermal expansion coefficient and the high thermal conductivity of the ceramic or cermet.

Preferably the two microcomposites are mixed in nearly equal volume percentages such that after treatment, about half of the macrocomposite has the tool steel microstructure and half has the ceramic or cermet microstructure. But the exact ratio can be varied by a person skilled in the art to achieve the best combination of properties in the macrocomposite for the desired application. The tool steel microstructure 12 is actually a combination of steel and small carbide particles (such as of tungsten, vanadium or molybdium, for example). The tool steel alloy powder is preferably formed by inert-gas or water atomization.

For purposes of illustration, microcomposite ceramic tungsten carbide powder particles 14 are shown in FIG. 4 after compaction as bound in a sea of tool steel 12. In FIG. 5, microcomposite cermet particles 16 (preferably formed from tungsten, carbon and cobalt) are shown after compaction bound in a sea of tool steel 12. In this example, the tungsten carbide is cemented in a matrix of cobalt to form the microcomposite powder particles 16.

Preferably the particle size for each of the constituents is approximately equal.

One example of the invention, in terms of thermal expansion and thermal conductivity, is shown in Table A (line 3), as a combination midway between tungsten carbide ceramic or cermet (line 1) and T-15 tool steel (line 2).

| | Thermal Expansion Coefficient $10^{-6}$ in/in/°F. | Thermal Conductivity Btu ft²/ft · °F. · hr |
|---|---|---|
| 1. Tungsten carbide | 2.6–3.0 | 55–65 |
| 2. T-15 tool steel | 6.6 | 13–16 |
| 3. 50% WC/T-15 macrocomposite invention | 4.0–4.8 | 30–40 |

In essence, the present invention recognizes that not only does tool steel demonstrate far better wear resistance than common alloy heat treated steel, but in addition, it is more compatible with a carbide. For example, alloyed steel typically includes 0.2 percent to 0.45 percent carbon and small amounts (less than 5 percent) of molybdenum and chromium, but tool steel (such as T-15) has cobalt, tungsten and carbon in good proportion. Thus a T-15 tool steel, for example, cooperates well chemically with a tungsten carbide ceramic (because the steel already has tungsten and carbon in it) and even better with a tungsten carbide-cobalt cermet (because the steel also has cobalt in it). Likewise the alternative tool steels set forth above yield improved compatibility also.

The better chemistry of the present combination reduces or avoids the formation of a reaction zone around the carbide cermet, even at 1250° C., and avoids mass migration of carbon out of the carbide compared to prior art macrocomposites using a heat treated steel matrix. Thus the resulting carbides retain their advantageous mechanical properties even after processing at high temperatures. In one example, the cobalt content at around 5 percent of the tool steel retards mass cobalt migration from a cobalt cermeted carbide to the tool steel matrix, thereby allowing the cermeted carbide to retain good toughness. Therefore, the tool steel and carbide materials combine quite well during the hot isostatic treatment to form an inherently tough macrocomposite with a unique combination of physical properties. The cermet might range from tungsten carbide 97 percent to 75 percent with cobalt at 3 percent to 25 percent.

As two further examples of the invention, 50 percent by volume of 50–100 μM tungsten carbide cermet particles, at 6 percent cobalt, were mixed with 50 percent by volume of similarly sized T-15 high speed tool steel, in one example, and M-4 type high speed tool steel in another example, respectively. These combinations were each respectively hot isostatically clad at 1200° C./15,000 psi for 2–4 hours in 0.325 inch thickness into rolls for use in the hot rolling of steel I-beams. The rolls were used in "annealed" and heat treated conditions. In all cases the macrocomposite tool steel/cemented carbide composite substantially outperformed straight or common D-2 and T-15 tool steel rolls. Other examples of the invention include M-4 or T-15 and WC; M-2 or T-15 and Wc+Co 12 percent; M-2 or T-15 and Wc+Co 17 percent; and H-11 and Wc+Co 12 percent, generally at 1200° C./15,000 psi for 2–4 hours, and then heat treated. Heat treating may include 1200° C. at 30 minutes, Ar quench and double temper at 565° C., for three hours, for example.

A preferred particle size is about 25–100 micron of crushed carbide. Any particle smaller than 100 microns would likely have been consumed or degraded in prior art processes using a tungsten cermet, such as in Champagne et al., owing to the migration of materials out of the tungsten carbide cermet, particularly at elevated temperatures. In the present invention, particle size and particle characteristics are not limitations, and are selected to be generally matched in size so as to facilitate blending.

Furthermore, in the composition of 50 percent by volume of T-15 tool steel and 50 percent particles of tungsten at 6 percent cobalt, the microhardness of the tungsten carbide particles after treatment (about 1700 vicker) was higher than what would be normally expected for tungsten carbide cobalt at 6 percent cobalt. It is believed that this occurs because some cobalt apparently migrates from the tungsten carbide cermet particle into the tool steel matrix. The tungsten carbide cermet remaining with lower cobalt is therefore converted to a lower cobalt binder carbide microcomposite material (with higher wear resistance) as it is held in the microcomposite tool steel matrix.

Cemented tungsten carbide cobalt and the ceramic tungsten carbide have very low coefficients of thermal expansion. If one of these carbide materials, say tungsten carbide, is clad onto an alloy steel substrate, the cermet coating will form cracks during cooling of the part. However, the new coating of the present invention as previously described has a coefficient of thermal expansion located somewhat between tool steel and the ceramic or cermet carbide, which makes the material easier to treat hot isostatically and to diffusion bond onto a tool steel substrate, with less likelihood of cracking as the coating and substrate cool. Therefore the present invention has very practical advantages in the manufacturing stage. Therefore, an assembly of the macrocomposite described above, as bonded to an alloy steel substrate, after being conventionally normalized, quenched and hardened, does not develop cracks.

Figure 6:
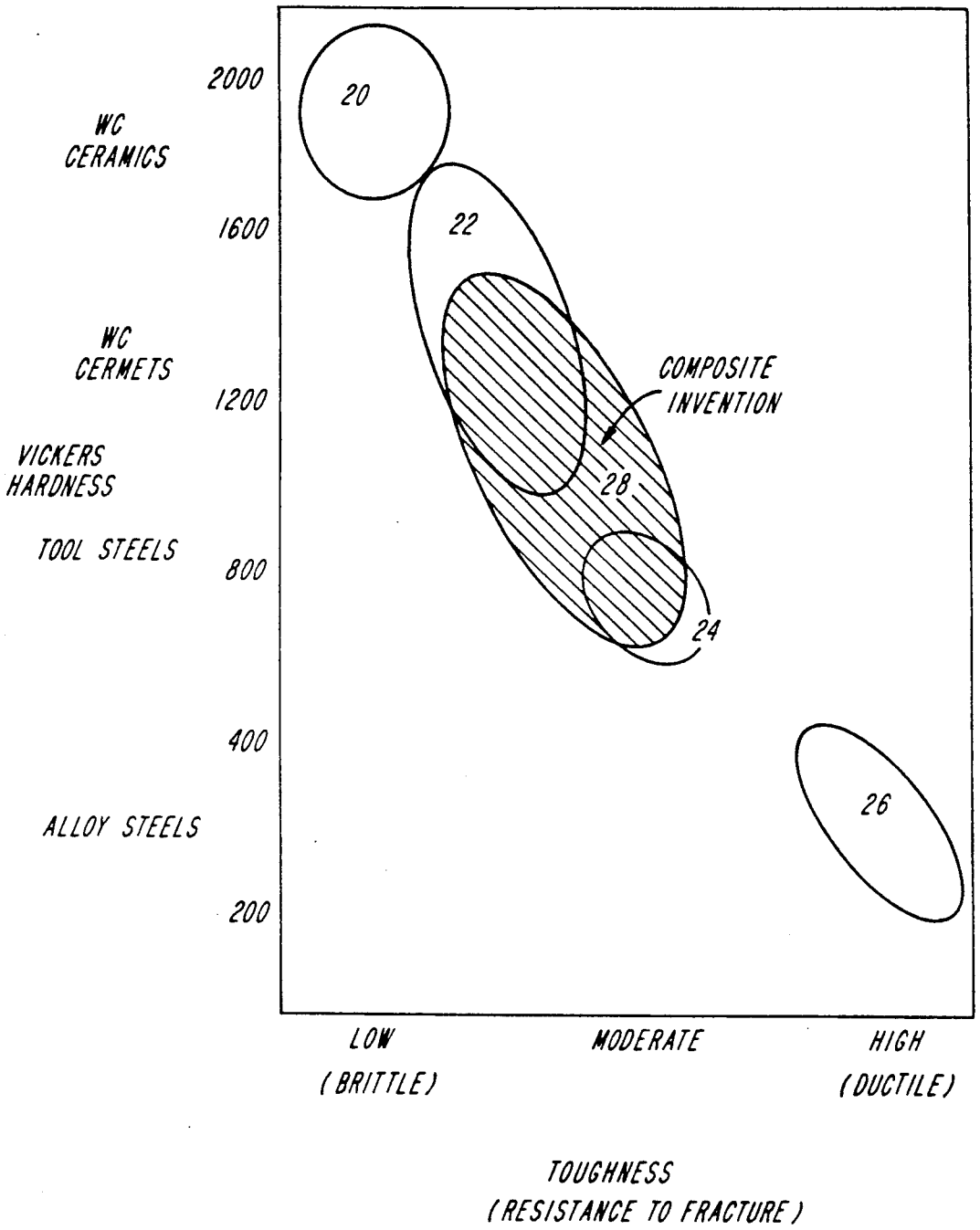
FIG. 6 is a graph comparing Vickers hardness to toughness for several classes of materials.

Turning to FIG. 6, a comparison is provided of the Vicker hardness (which is related to wear resistance) versus toughness (which is related to resistance to fracture) of various materials including the macrocomposite of the present invention 28, common alloy steel 26, common tool steel 24, tungsten carbide cermet 22 and ceramic 20.

The tungsten carbide ceramic 20 has a hardness of about 2200 Vickers, but is very brittle (i.e., low toughness). A tungsten carbide cermet 22 (such as tungsten carbide cobalt) has a Vickers hardness typically from about 1500 to 1800, and being less brittle, is considered a more useful composite than the carbide ceramic. The alloy steels 26 typically have Vicker hardness from about 200 to 400 and relatively high toughness. Tool steels 24 range from about 600 to 950 Vickers with moderate toughness and higher wear resistance than alloy steel. The present invention combines the benefits of the carbides (either ceramic or cermet) and of tool steel to obtain a class of materials 28 with hardness perhaps in the range of 600 to 1700 Vickers, having moderate toughness and much higher wear resistance than mere alloy steel or tool steel.

It will be understood that the above description pertains to only several embodiments of the present invention. That is, the description is provided by way of illustration and not by way of limitation. The invention, therefore, is to be defined according to the following claims.

What is claimed is:

1. A process for forming a macrocomposite having improved thermal fatigue resistance comprising the steps of (a) mixing a tool steel microcomposite alloy powder and a carbide microcomposite powder to form a powder mass in a manner that said powders are generally well distributed in said mass, said carbide microcomposite powder being formed of particles from about 25–100 micrometers in diameter, and (b) hermetically sealing and heating said mass isostatically to a temperature of at least 1100 C, at at least 2–3000 psi, until said mass is diffusion bonded into a macrocomposite having (i) a tool steel matrix, formed from said tool steel microcomposite powder, and (ii) carbide islands, formed from said carbide microcomposite powder dispersed in said matrix.

2. The process of claim 1 wherein said step of mixing of powders includes plasma spraying the powders onto a substrate.

3. The process of claim 1 wherein said step of mixing of powders includes mechanically mixing said powders in a magnetic field.

4. The process of claim 3 wherein said step of mixing further includes vibrating said powders.

5. The process of claim 1 wherein step (b) includes placing a substrate in a container and further including a step (c) of cladding the mass onto the substrate by hot isostatic pressing.

6. The process of claim 1 wherein said tool steel microcomposite is selected from the group consisting of W, S, O, A, D, H, T, M, L, F, P and CPM tool steels.

7. The process of claim 1 wherein said tool steel comprises M-4 or T-15 steel and said carbide includes tungsten.

8. The process of claim 1 wherein said tool steel comprises M-4 or T15 steel and said carbide is a tungsten carbide cobalt cermet at about 6 percent cobalt.

9. The process of claim 1 wherein said tool steel comprises M-4 or T15 steel and said carbide is a tungsten carbide cobalt cermet at about 12 percent cobalt.

10. The process of claim 1 wherein said tool steel comprises M-2 or T15 steel and said carbide is a tungsten carbide cobalt cermet at about 17 percent cobalt.

11. The process of claim 1 wherein said tool steel comprises H-11 steel and said carbide is a tungsten carbide cobalt cermet at about 12 percent cobalt.

12. The process of claim 1 wherein said tool steel microcomposite powder is comprised of T-15, M-2, H-11 or M-4 tool steel.

13. The process of claim 1 wherein said carbide is formed from the group consisting of: tungsten carbide, tantalum carbide, titanium carbide, niobium carbide, hafnium carbide, vanadium carbide and silicon carbide.

14. The process of claim 13 further including a cobalt, nickel, chromium, or molybdenum binder phase.

15. The process of claim 1 wherein said tool steel microcomposite powder and said carbide microcomposite powder are mixed in a ratio of between 3:1 and 1:3.

16. The process of claim 1 wherein said tool steel microcomposite powder and said carbide microcomposite powder are mixed in a ratio of about 1:1.

17. The process of claim 13 wherein the carbide microcomposite powder is at least 30 percent of said powder mass.

18. The process of claim 1 wherein the carbide microcomposite powder comprises angularly shaped particles.

19. The process of claim 1 wherein the carbide microcomposite powder comprises spherically shaped particles.

20. The process of claim 1 wherein the tool steel has a carbon content of between about 1 to 2 percent.

21. The process of claim 1 further including the step of selecting the powder particle size for each of said microcomposites to be approximately equal.

22. The process of claim 1 further including the step of heating the hermetically sealed mass to a temperature of about 1200°–1205° C. at 15 Kpsi.

23. The process of claim 1 wherein said mass is heated to a temperature within the range of 1100°–1250° C. for a time period and pressure sufficient to achieve full density.

24. The process of claim 23 wherein the step of heating includes the step of heating in a pressurized environment of about 15,000 psi.

25. The process of claim 23 wherein said time period is about 4 hours and said pressure is about 15,000 psi.

* * * * *